US011672282B2

(12) United States Patent
Boos

(10) Patent No.: US 11,672,282 B2
(45) Date of Patent: Jun. 13, 2023

(54) MAGNET AND MAGNET HOLDER

(71) Applicant: Jonathan B. Boos, Sarasota, FL (US)

(72) Inventor: Jonathan B. Boos, Sarasota, FL (US)

(73) Assignee: WURKIN STIFFS PATENT HOLDING, LLC, Dover, DE (US)

( * ) Notice: Subject to any disclaimer, the term of this patent is extended or adjusted under 35 U.S.C. 154(b) by 225 days.

(21) Appl. No.: 16/893,030

(22) Filed: Jun. 4, 2020

(65) Prior Publication Data

US 2020/0383384 A1 Dec. 10, 2020

Related U.S. Application Data

(60) Provisional application No. 62/857,580, filed on Jun. 5, 2019.

(51) Int. Cl.
*A41B 3/08* (2006.01)
*A41F 1/00* (2006.01)

(52) U.S. Cl.
CPC ..... *A41B 3/08* (2013.01); *A41F 1/002* (2013.01)

(58) Field of Classification Search
CPC .. A41B 3/06; A41B 3/08; A41B 3/005; A41B 3/02; A41B 3/04; A41B 3/12; A41B 3/00–3/18; A41B 1/10; A41B 7/02; A41B 2300/324; A41B 3/16; A41B 2300/30; A41F 1/002; A41D 27/06; A41D 27/08; A44D 2203/00; F16B 2001/0035; A44B 1/00; A44B 1/02; A44B 1/08; A44B 17/00; A44B 17/0041; A44B 17/0064; A44B 17/0076; A44B 3/00
USPC ..... 2/132, 134, 255–263; 24/303, 66.1, 24/900.1
See application file for complete search history.

(56) References Cited

U.S. PATENT DOCUMENTS

| | | | | | |
|---|---|---|---|---|---|
| 818,817 | A * | 4/1906 | Collins | A41B 3/06 | 2/134 |
| 913,435 | A * | 2/1909 | Schloss | A41B 3/06 | 2/134 |
| 1,764,212 | A * | 6/1930 | Kirsten | A41B 3/06 | 2/137 |
| 2,599,421 | A * | 6/1952 | Wilm | A41B 3/00 | 2/116 |
| 2,651,782 | A * | 9/1953 | Oulouhojian | A41B 3/06 | 2/132 |
| 3,075,202 | A * | 1/1963 | Rubio | A41B 3/06 | 2/132 |
| 4,118,803 | A * | 10/1978 | Blau | A41B 3/08 | 2/262 |

(Continued)

FOREIGN PATENT DOCUMENTS

| | | | | |
|---|---|---|---|---|
| CN | 1260151 A | * | 7/2000 | A41F 1/002 |
| CN | 106165910 A | * | 11/2016 | |

(Continued)

*Primary Examiner* — Amy Vanatta
(74) *Attorney, Agent, or Firm* — Daniel J. Polglaze; Westman, Champlin & Koehler, P.A.

(57) ABSTRACT

A collar stay includes a stay body having an opening therein, and a magnet configured to be retained in the opening. The magnet has at least one indentation around an outer circumference thereof. The opening includes an inner circumferential surface having at least one protrusion therefrom, the protrusion shaped to engage the at least one indentation to retain the magnet in the opening.

15 Claims, 5 Drawing Sheets

(56) References Cited

U.S. PATENT DOCUMENTS 5,142,746 A * 9/1992 Morita ..... A45C 13/1069 24/303
5,450,658 A * 9/1995 Hicks ..... D06F 95/008 24/303
6,163,889 A * 12/2000 Tate ..... A63B 57/353 2/209.13
6,226,842 B1 * 5/2001 Wong ..... A45C 13/1069 24/66.1
6,606,767 B2 * 8/2003 Wong ..... A41F 1/006 24/303
6,748,602 B1 * 6/2004 Barnes ..... A41B 3/06 2/132
7,409,730 B2 8/2008 Boos
8,108,948 B2 2/2012 Boos
8,813,264 B2 8/2014 Boos
8,875,542 B2 * 11/2014 Severs ..... A44C 17/0208 63/900
D782,784 S * 4/2017 Smith ..... A41B 3/06 D2/859
9,943,117 B2 4/2018 Boos
2007/0204374 A1 * 9/2007 Bier ..... A41D 27/08 2/60
2012/0151661 A1 * 6/2012 Boos ..... A41B 3/08 2/258
2014/0345031 A1 * 11/2014 Reidsema ..... A41B 3/06 2/132
2014/0366242 A1 * 12/2014 Pulsifer ..... A41B 3/04 2/139
2015/0000010 A1 * 1/2015 Boos ..... A41F 1/002 2/259

FOREIGN PATENT DOCUMENTS

KR 20130006057 U * 10/2013
KR 101900448 B1 * 11/2018 ..... A41F 1/002

* cited by examiner

MAGNET AND MAGNET HOLDER

BACKGROUND

Neodymium magnets are known to be brittle by nature, but have a high-strength pull force in their magnetism. When two neodymium magnets come together without protection, they can chip and break. Also, the nature of neodymium material makeup limits its capability to adhere these magnets to other materials utilizing an adhesive and/or epoxy, such as plastics, silicones, etc. The adhesion strength is either compromised and/or does not allow the two materials to adhere whatsoever. Further, adhesives can breakdown over time.

SUMMARY

In one embodiment, a collar stay includes a stay body having an opening therein, and a magnet configured to be retained in the opening. The magnet has at least one indentation around an outer circumference thereof. The opening includes an inner circumferential surface having at least one protrusion therefrom, the protrusion shaped to engage the at least one indentation to retain the magnet in the opening.

Other aspects of this embodiment include wherein the opening is substantially circular; wherein the magnet has a thickness larger than the thickness of the opening; and wherein the opening has a cover on one face of the collar stay that covers the magnet when the magnet is engaged in the opening.

Other aspects of this embodiment further include wherein the at least one indentation comprises a single indentation that extends fully around the outer circumference; wherein the at least one protrusion comprises a ridge extending fully around the inner circumferential surface; wherein the at least one protrusion comprises a plurality of individual protrusions spaced equally around the inner circumferential surface; wherein the at least one indentation comprises a plurality of individual indentations spaced equally around the inner circumferential surface; and wherein the at least one protrusion comprises a plurality of individual protrusions spaced equally around the inner circumferential surface, and wherein the plurality of individual indentations conformally matches the plurality of individual protrusions.

In another embodiment, a collar stay, includes a magnet having at least one indentation around an outer circumference thereof, and a stay body having an opening therein. The stay body is formed in one embodiment formed by molding a stay portion that mates with the opening to retain the magnet in the opening.

Other aspects of this embodiment include wherein the opening is substantially circular; wherein the magnet has a thickness larger than the thickness of the opening; wherein the opening is molded with a cover on one face of the collar stay that covers the magnet when the magnet is engaged in the opening; and wherein the body is formed by injection molding.

In another embodiment, a method of manufacturing a collar stay includes molding a collar stay body having an opening molded around a magnet to retain the magnet in the opening of the collar stay body. Molding includes molding to engage a protrusion on the magnet to retain the magnet in the opening.

Other aspects of this embodiment include wherein molding further comprises molding a cover over one face of the magnet; and wherein molding comprises injection molding.

DETAILED DESCRIPTION

Figure 1:
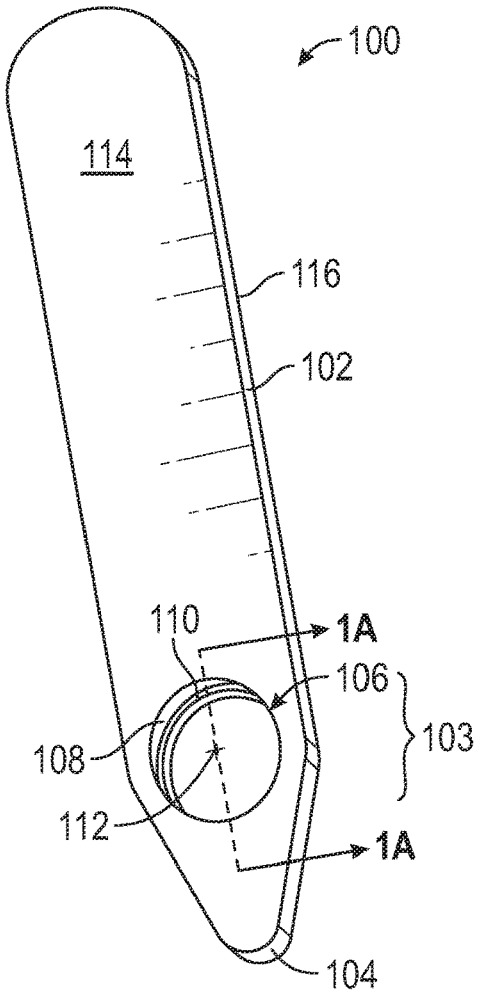
FIG. 1 is a perspective view of a collar stay body according to an embodiment of the present disclosure.

FIG. 1 is a perspective view of a collar stay 100 according to an embodiment of the present disclosure. Collar stay 100 comprises a stay body 102 and a tapered point 104. In one embodiment, and opening 106 is provided in the stay body 102. Opening 106 is in one embodiment positioned at a transition area 103 between the stay body 102 and the taper to the tapered point 104, although it should be understood that a different position for the opening 106 may be employed without departing from the scope of the disclosure.

Opening 106 in one embodiment comprises an opening wall 108 having a ridge 110. Ridge 110 extends from opening wall 108 toward a center 112 of opening 106. In one embodiment, opening 108 is substantially circular, although other opening shapes are contemplated and are within the scope of the disclosure. Further, while ridge 110 is described as extending from the opening wall 108 toward a center 112 of the opening 108, it should be understood that the function of ridge 112 may also be met by a depression in wall 108, as will be evident from the disclosure below.

Figure 1A:
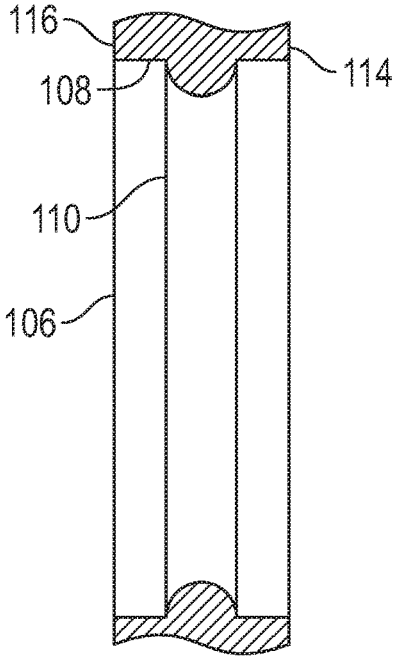
FIG. 1A is a partial cutaway view taken along lines 1A-1A of FIG. 1.

The opening 108 in one embodiment allows an insert to be snapped into place in the opening 106, and for the insert to be held in the opening 106, with the insert having faces that are exposed to both a front side 114 and a back side 116 of the collar stay 100. FIG. 1A is cutaway view of the opening 106 taken along lines 1A-1A of FIG. 1.

Figure 1B:
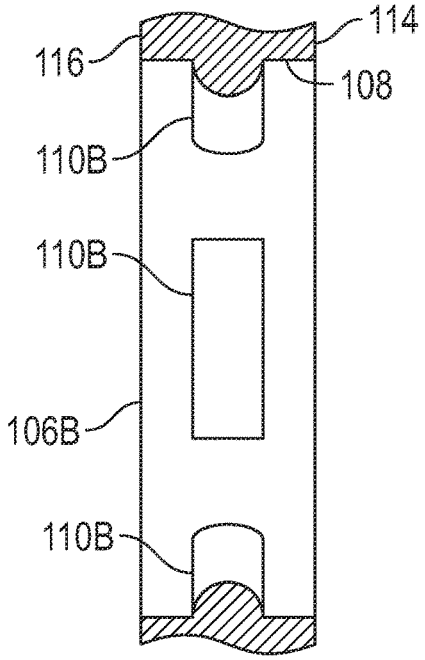
FIG. 1B is a partial cutaway view of another embodiment of a collar stay opening.

In another embodiment, shown in FIG. 1B, ridge 110 of opening 106B may be noncontinuous, for example, a plurality of spaced apart protrusions 110B that do not extend fully around the surface 108 of opening 106B. Such noncontinuous protrusions 110B are shown in a cutaway view in FIG. 1B, in a view similar to that of FIG. 1A, but showing the noncontinuous protrusions 110B. Protrusions 110B may be equally spaced about the surface 108, and more or fewer protrusions 110B than are shown may be used without departing from the scope of the disclosure.

Figure 2A:
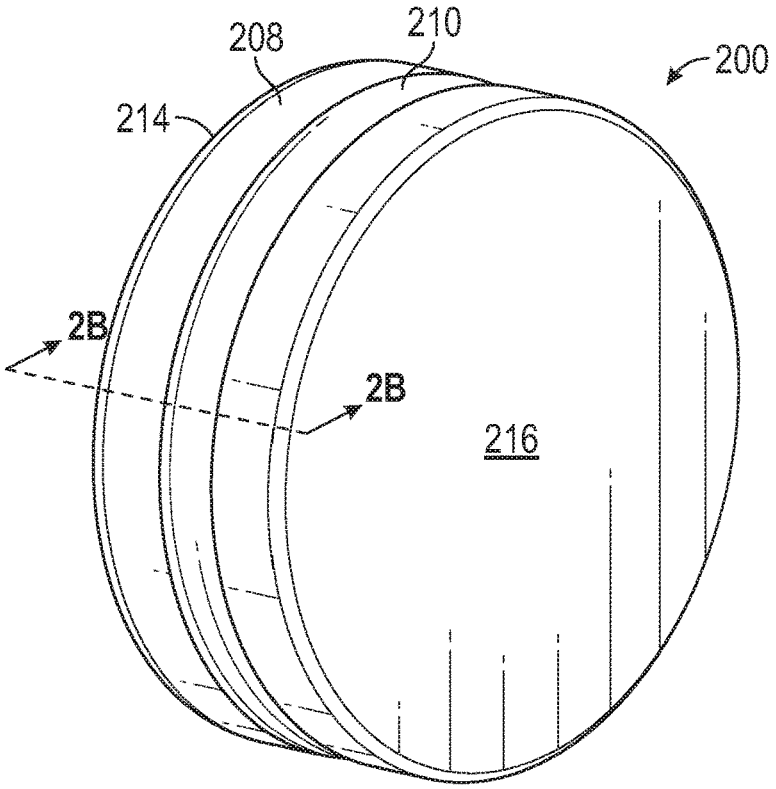
FIG. 2A is a perspective view of a magnet according to an embodiment of the present disclosure.
Figure 2B:
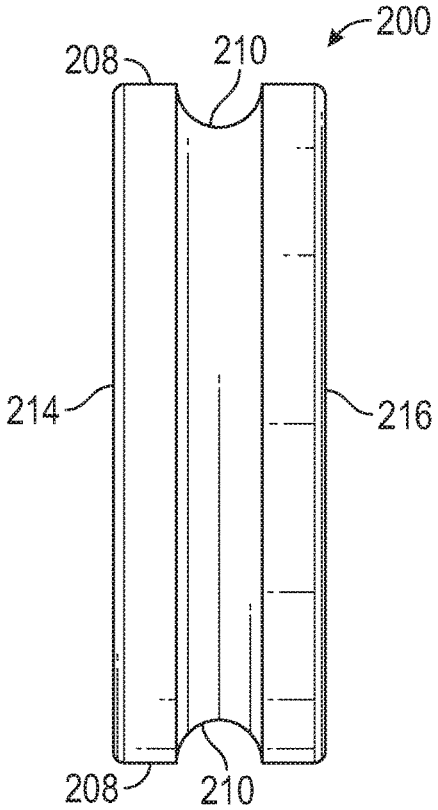
FIG. 2B is a side elevation view of the magnet of FIG. 2A.

Opening 106 is configured in one embodiment to accommodate the snapping into place in the opening 106 of a magnet 200 such as is shown in FIGS. 2A and 2B. Magnet 200 comprises in one embodiment a two sided magnet, in one embodiment a neodymium magnet, with sides 214 and 216. The magnet 200 has an external outer circumferential surface 208 with an indentation 210 therein. The indentation, or groove, 210, in one embodiment, extends fully around the circumferential outer surface 208 at substantially a midpoint between sides 214 and 216. In one embodiment, the indentation 210 is matched to the shape of the ridge 110 in collar stay 100 opening 106. It should be understood that the ridge 110 and indentation 210 may be positioned other than at or near the midpoint between the sides 114, 116 or 214, 216, respectively, without departing from the scope of the disclosure.

Alternatively, instead of a magnet 200, an insert configured and shaped to snap into opening 106 may be made of a ferromagnetic material, and a magnet may be used as an attachment backing device on a shirt collar or the like.

Figure 3B:
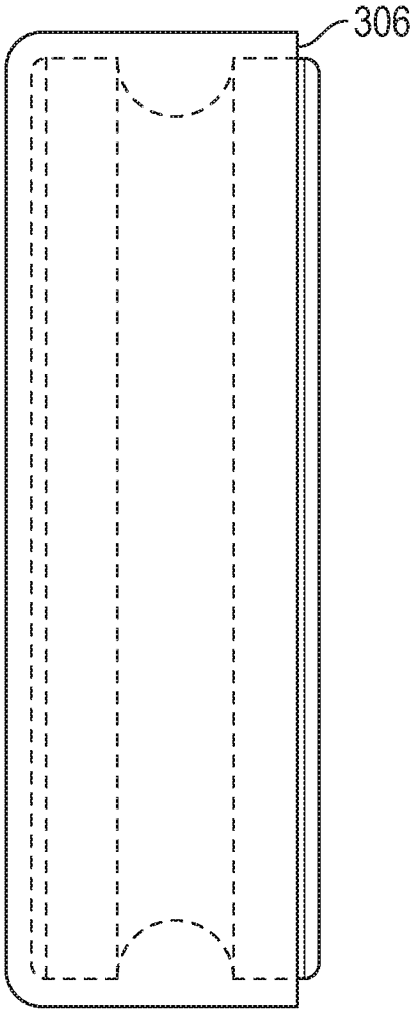
FIG. 3B is a partial side elevation view of an assembled collar stay according to another embodiment of the present disclosure.
Figure 3A:
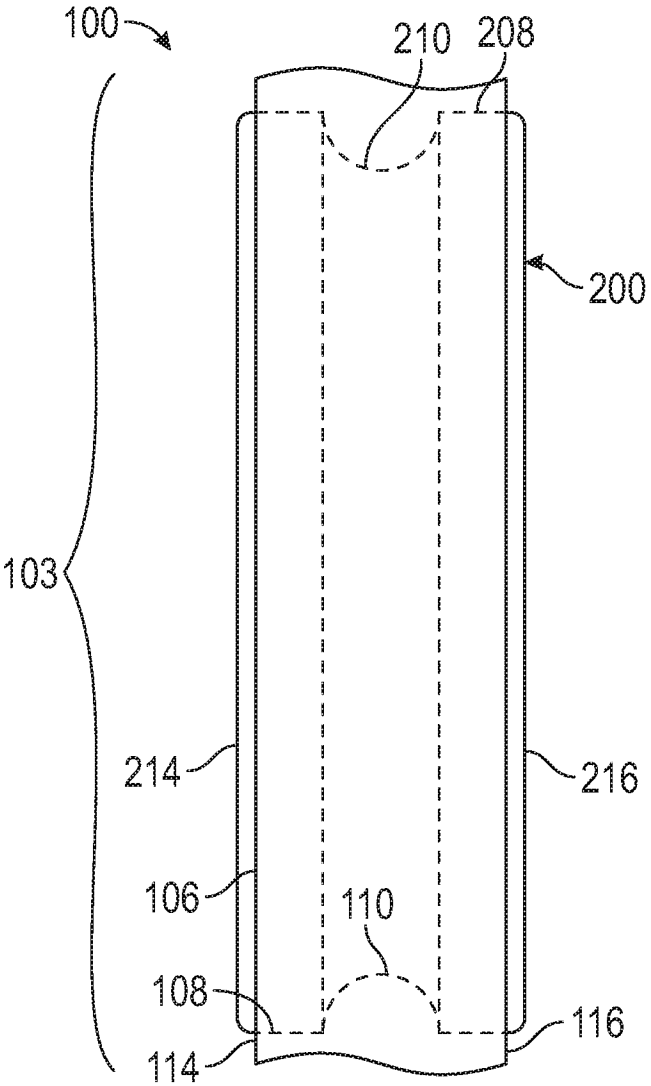
FIG. 3A is a partial side elevation view of an assembled collar stay according to an embodiment of the present disclosure.

FIG. 3A is a side partial cutaway view of a magnet 200 snapped into opening 106, where the ridge 110 and the indentation or groove 210 are matched to retain the magnet 200 within opening 106, leaving sides 214 and 216 of magnet 200 exposed.

Figure 4A:
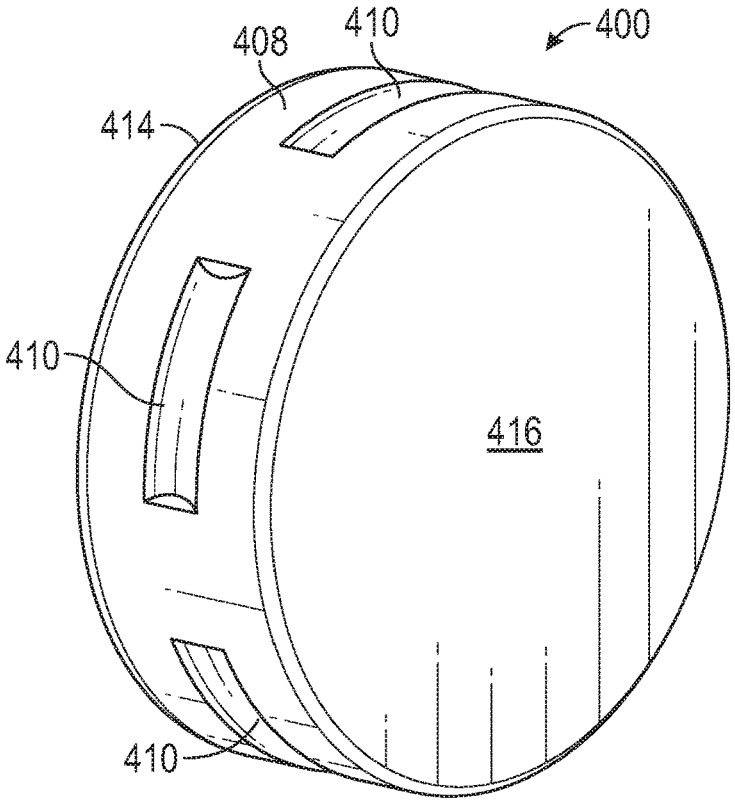
FIG. 4A is a perspective view of a magnet according to an embodiment of the present disclosure.
Figure 4B:
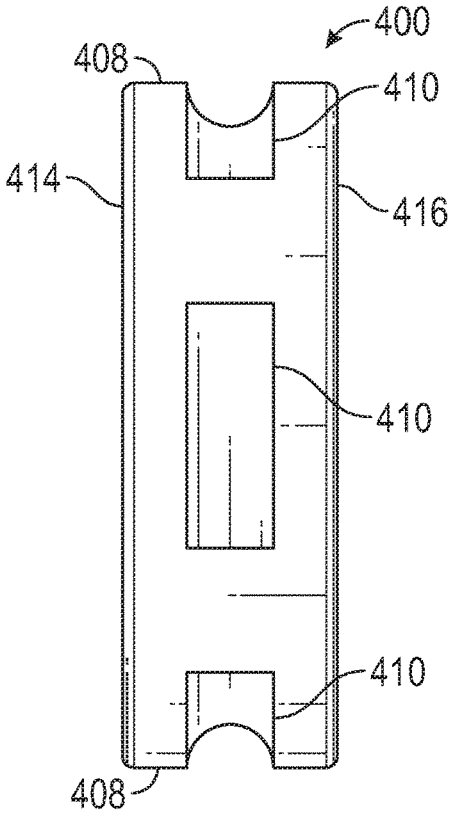
FIG. 4B is a side elevation view of the magnet of FIG. 4A.

When an opening 106 with noncontinuous protrusions 110B is used, the magnet 200 may still be used without changes to its design. The continuous indentation 210 will accommodate protrusion 110B as well as complete ridge 110. However, in another embodiment as shown in FIGS. 4A and 4B, a magnet 400 is illustrated in perspective (FIG. 4A) and side elevation (FIG. 4B) views. Magnet 400 comprises in one embodiment a two sided magnet, in one embodiment a neodymium magnet, with sides 414 and 416. The magnet 400 has an external outer circumferential surface 408 with a noncontinuous plurality of indentations 410 therein, in on embodiment equally spaced about the circumferential surface 408. The indentations, or grooves, 410, in one embodiment, are positioned within the circumferential outer surface 408 at substantially a midpoint between sides 414 and 416. with such a set of indentations 410, a collar stay opening such as opening 106B in FIG. 1B is used, with the protrusions 110B matching the indentations 410 in magnet 400. Further, the number of protrusions 110B may be fewer than the number of indentations 410. In one embodiment, the indentations 410 are matched to the shape of the ridge 110 in collar stay 100 opening 106. It should be understood that the protrusions 110B and indentations 410 may be positioned other than at or near the midpoint between the sides 114, 116 or 414, 416, respectively, without departing from the scope of the disclosure.

In operation, to assemble a completed collar stay such as stay 100, a magnet 200 or 400 (or other ferromagnetic insert) is snapped into opening 106 (accepts magnet 200) or 106B (accepts magnets 200 or 400), where the ridge 110 or protrusions 110B within opening 106 or 106B and the indentation 210 on outer circumferential surface 208 of magnet 200 (or other ferromagnetic insert) or noncontinuous indentations 410 on outer circumferential surface 408 of magnet 400 serve to secure the magnet 200, 400 (or other ferromagnetic insert) within stay 100 without using an adhesive. The snap fit holds the magnet 200, 400 securely in the opening 106, 106B, with sides 214/414 and 216/416 exposed. Such exposed sides may be used with a decorative etched or otherwise applied pattern, for example.

FIG. 3B illustrates that a magnet such as magnet 200 may be inserted into a cavity-type opening 306 in a collar stay such as collar stay 100, the magnet having an indentation and the cavity opening 306 having only one exposed side of the magnet.

By creating a groove or indentation such as indentation 210 on a circumferential outer surface 208 of the magnet 200 (or other ferromagnetic insert), either continuous and/or noncontinuous, the magnet 200 conforms to the material that has an opening and a corresponding ridge, such as opening 106 having a ridge 110. The ridge 110 on the secondary material accepts the grooved magnet to form a fixture. The ridge can either have a continuous (ridge 110) and/or noncontinuous (protrusions 110B) configuration which corresponds to the groove/indentation placement on the magnets 200/400. Furthermore, the magnet can have a continuous groove (magnet 200), while the ridged part has either a noncontinuous or continuous ridge. If the magnet has a noncontinuous groove (magnet 400), the ridged material is noncontinuous (protrusions 110B) to accept the magnet, thus allowing the magnet to be fixed inside the ridged material.

Advantages of the embodiments of the present disclosure include:

- Allow a neodymium magnet to be accepted and fixed inside a protective cover without adhesive, exposing one or more sides of the magnet.
- Protective cover aids in preventing magnet from chipping and/or breaking apart from hitting on edges.
- Allow a neodymium magnet to be accepted and fixed inside a separate part without adhesive, exposing one or more sides of the magnet.
- Exposing the neodymium magnet retains the fullest potential pull strength of utilized magnet when connected with the exposed surface.

The magnet may be exposed on one or more sides as shown in the drawings. The separate part (e.g., stay 100) may be made of various material such as plastics, rubbers, metals, etc. Further, while a stay body 102 for a collar stay 100 is discussed, it should be understood that other objects (see FIGS. 5 and 6) could be used with embodiments of the present disclosure without departing from the scope thereof.

Still further, while a preformed opening such as opening 106 is discussed, alternate formations may also be used. For example, any exterior edge shape of a magnet such as magnet 200, 400, may be used with an injection molding process or other molding process to mold of form a body such as stay body 102 around the exterior of the magnet 200, 400 to conform the holder to the magnet (or other ferromagnetic material). In this way, other magnet shapes and exterior-edge features may be used without departing from the scope of the disclosure.

There are be at least two methods of inserting the magnets (e.g., magnets 200, 400) into the locked groove/ridge system:

1. Mechanically pushing the part and magnet together, allowing them to snap/lock together.
2. Injecting the separate material around the magnet, allowing them to be locked together.

The groove inside the magnet can be as shallow and/or deep as warranted to lock the two materials together. Also, the ridge/protrusions can be as shallow and/or deep as warranted to lock the two materials together.

While disc shaped magnets that have a substantially circular circumference have been described, it should be understood that other shapes of magnets with corresponding shapes of openings may be used without departing from the scope of the disclosure. Other shapes include by way of example only and not by way of limitation:

Disc
Round
Sphere
Cube
Square
Rectangle

Triangle etc.

The embodiments of the present disclosure provide a magnet design with a groove around its outer edge which enables:

a better grasp to pull-off a small magnet from any magnetic surface.

a plastic cover to surround the magnet without adhesive either by snapping on and/or plastic injection process.

The embodiments of the present disclosure also provide a plastic magnet cover which exposes one side of the magnet with a ridge design to snap onto a magnet.

The embodiments of the present disclosure also provide a plastic collar stay which utilizes the grooved magnet to expose two sides of the magnet.

Figure 5:
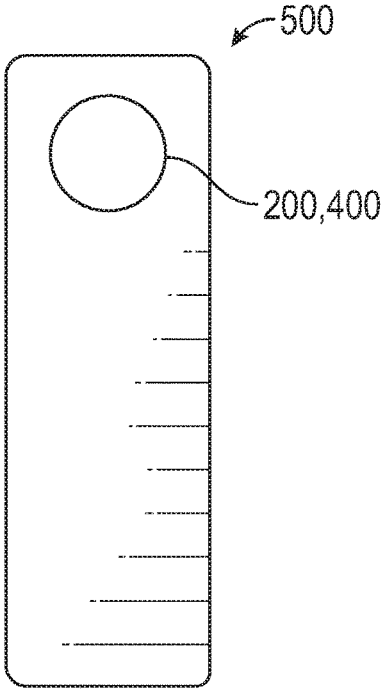
FIGS. 5 and 6 are elevation views of alternate objects on which embodiments of the present disclosure may be used.
Figure 6:
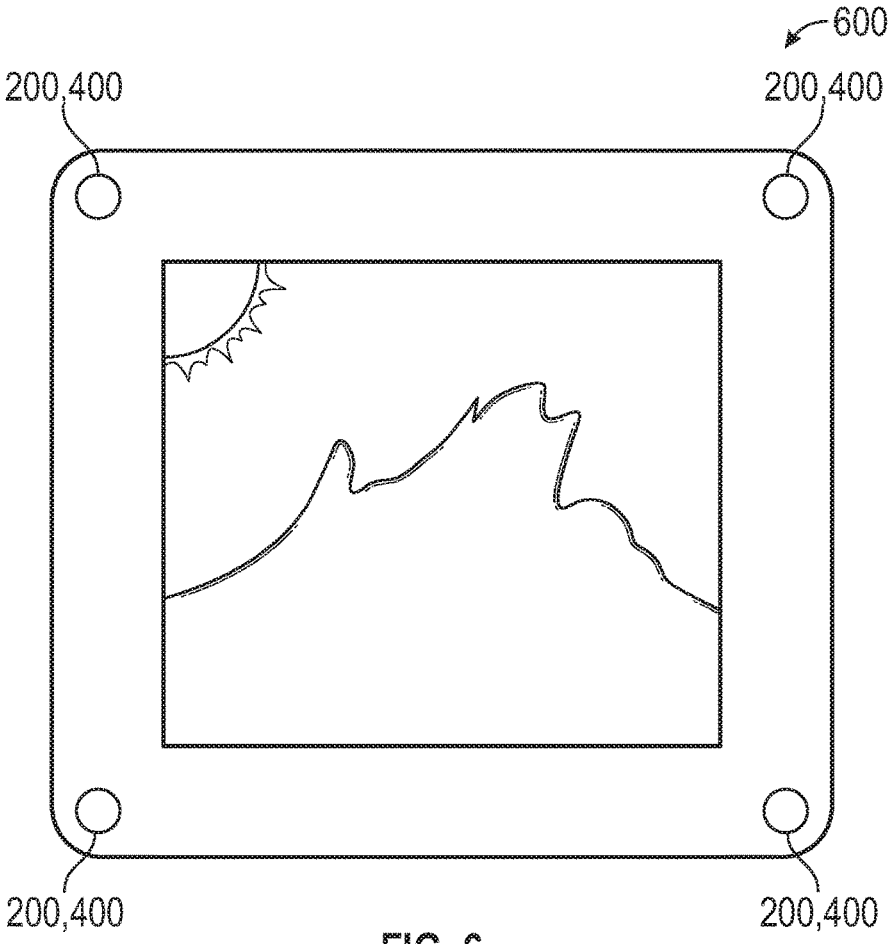

While collar stays are discussed, it should be understood that the embodiments of the present disclosure are amenable to use with other objects having a snap-in or injected-around body, with magnets 200, 400 in openings as discussed above, but in an object such as but not limited to a refrigerator magnet 500, a picture frame 600, or the like, as shown in rough form in FIGS. 5 and 6.

Although the present disclosure has been described with reference to preferred embodiments, workers skilled in the art will recognize that changes may be made in form and detail without departing from the spirit and scope of the disclosure.

What is claimed is:

1. A collar stay, comprising:

a stay body having an opening extending fully therethrough from a first side to a second side of the collar stay; and a magnet configured to be retained in the opening, the magnet having at least one indentation around an outer circumference thereof;

wherein the opening comprises an inner circumferential surface having at least one protrusion therefrom, the protrusion shaped to engage the at least one indentation to retain the magnet in the opening.

2. The collar stay of claim 1, wherein the opening is substantially circular.

3. The collar stay of claim 1, wherein the at least one indentation comprises a single indentation that extends fully around the outer circumference.

4. The collar stay of claim 1, wherein the at least one protrusion comprises a ridge extending fully around the inner circumferential surface.

5. The collar stay of claim 1, wherein the at least one protrusion comprises a plurality of individual protrusions spaced equally around the inner circumferential surface.

6. The collar stay of claim 1, wherein the at least one indentation comprises a plurality of individual indentations spaced equally around the outer circumference.

7. The collar stay of claim 6, wherein the at least one protrusion comprises a plurality of individual protrusions spaced equally around the inner circumferential surface, and wherein the plurality of individual indentations conformally matches the plurality of individual protrusions.

8. The collar stay of claim 1, wherein the magnet has a thickness larger than the thickness of the opening.

9. The collar stay of claim 1, wherein the magnet has faces that extend beyond a plane of the first side and beyond a plane of the second side when the magnet is retained in the opening.

10. The collar stay of claim 1, wherein the magnet comprises a ferritic material part in the opening and a magnet separate from the ferritic material and external to the opening.

11. A collar stay, comprising:

a magnet having at least one indentation around an outer circumference thereof; and a stay body having an opening extending fully therethrough from a first side to a second side of the collar stay, the opening including a stay portion that mates with the at least one indentation of the magnet to retain the magnet in the opening.

12. The collar stay of claim 11, wherein the opening is substantially circular.

13. The collar stay of claim 11, wherein the magnet has a thickness larger than the thickness of the opening.

14. The collar stay of claim 11, wherein the body is formed by injection molding.

15. The collar stay of claim 11, wherein the magnet has faces that extend beyond a plane of the first side and beyond a plane of the second side when the magnet is retained in the opening.

* * * * *